United States Patent [19]

Mallory

[11] 4,178,827

[45] Dec. 18, 1979

[54] STRINGED INSTRUMENT CONSTRUCTION

[76] Inventor: William K. Mallory, 2115 S. 128th St., Seattle, Wash. 98168

[21] Appl. No.: 897,797

[22] Filed: Apr. 19, 1978

[51] Int. Cl.[2] ..... G10D 1/08

[52] U.S. Cl. ..... 84/291; 84/294; 84/307

[58] Field of Search ..... 84/267, 268, 270, 271, 84/275, 284, 290–292, 294, 298, 299, 307

[56] References Cited

U.S. PATENT DOCUMENTS

| | | | |
|---|---|---|---|
| 980,938 | 1/1911 | Gasche | 84/291 |
| 1,364,466 | 1/1921 | Van Eps | 84/270 |
| 1,889,408 | 11/1932 | Larson | 84/292 |
| 3,656,395 | 4/1972 | Kaman | 84/267 |
| 4,079,654 | 3/1978 | Kasha | 84/291 |

*Primary Examiner*—Lawrence R. Franklin
*Attorney, Agent, or Firm*—Nicolaas DeVogel

[57] ABSTRACT

A stringed musical instrument having a body which includes a top, back and a neck, with a varied number of strings. The top is a flat sound board assembly, with a sound hole, which has a bridge and, on the underside, a bracing system mounted to the board and directly connected by fasteners through the board to the bridge for transmitting string vibrations via the bridge fasteners and braces on the board to the body interior. The back is a molded unit specifically shaped to increase the volume of sound produced by focalizing and directing it through the sound hole in the board. The combination of the direct fastener connection, bracing system and curved back for focussing the vibrations increases the sound volume and quality.

4 Claims, 9 Drawing Figures

FIG. 1
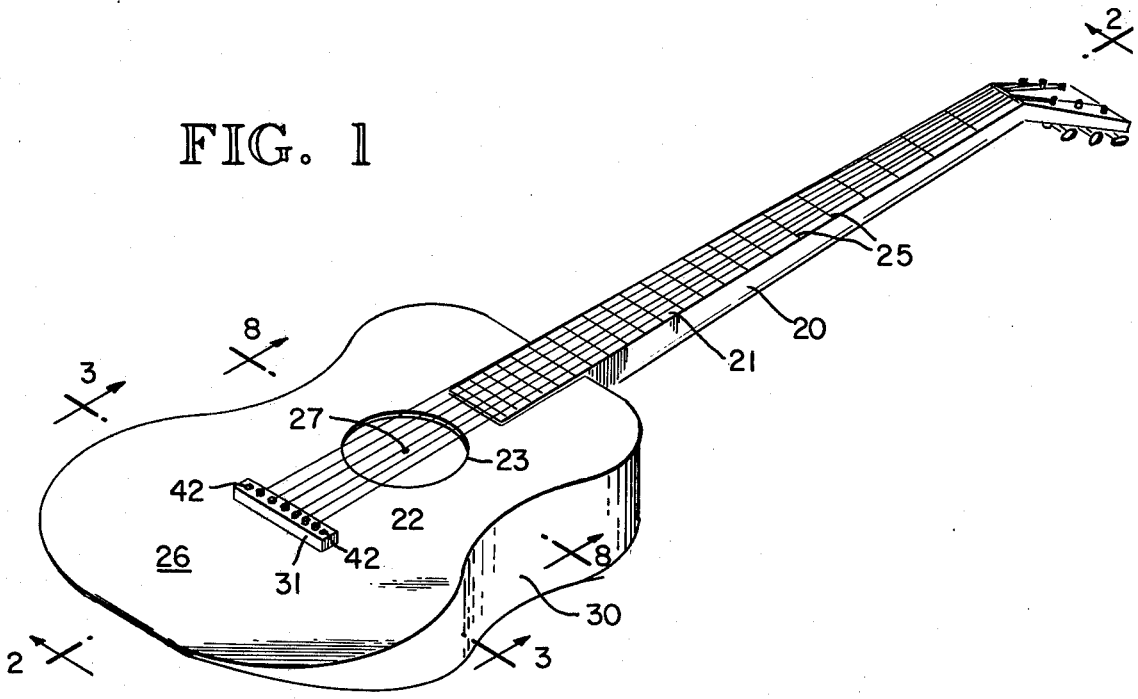
FIG. 2
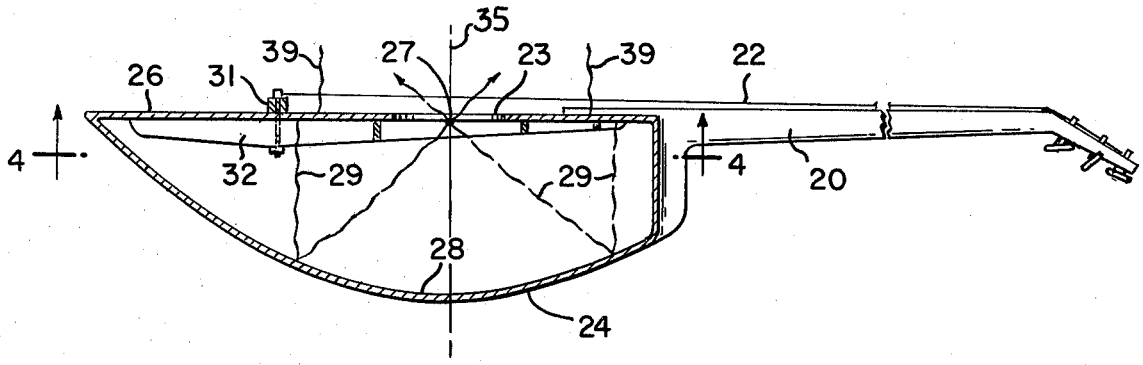
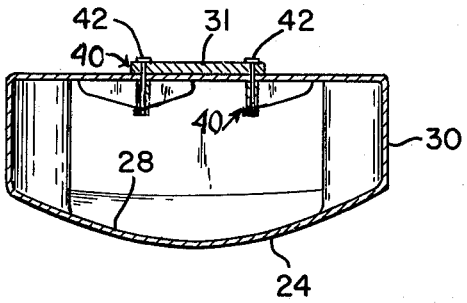
FIG. 3

FIG. 4
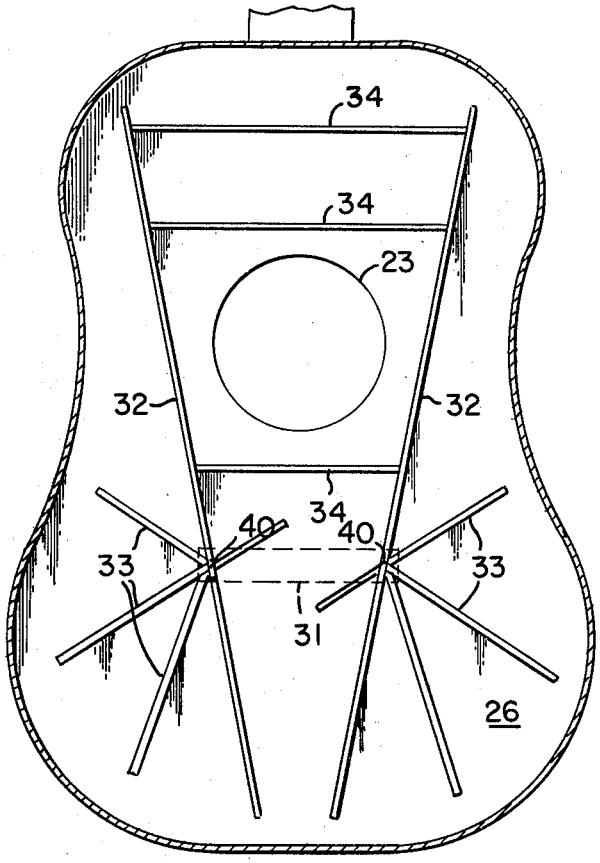
FIG. 9
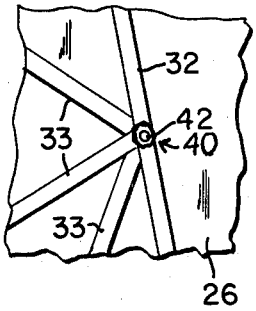
FIG. 5
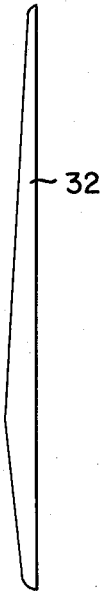
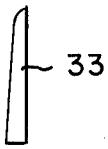
FIG. 6
FIG. 7
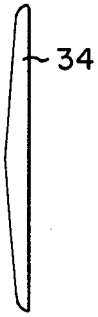
FIG. 8
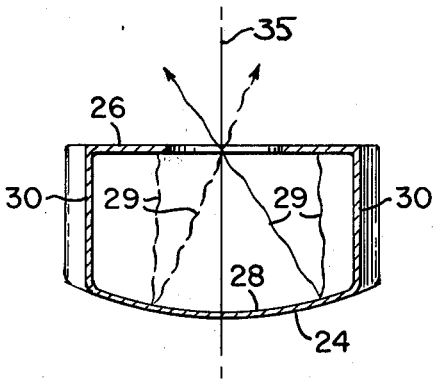

STRINGED INSTRUMENT CONSTRUCTION

BACKGROUND OF THE INVENTION

1. Field of the Invention

This invention relates to stringed instruments, and more particularly to the construction of the instrument for improving the volume and quality of the sound produced.

2. Description of the Prior Art

Because box-type stringed instruments (those instruments having both flat tops and backs) tend to trap a portion of the sound inside, they lose some of the energy produced by the vibrating strings through the soundboard and into the interior of the instrument. The sound waves bounce off the back, oscillating more or less within the same area and tending to cancel one another; they lose energy on every bounce and only slightly affect the back as a resonator.

Instruments with gently curved tops and/or backs are not without problem, in that the waves are now directed to other areas of the interior of the instrument, and because they have no purposeful direction, they become dissipated before they are fully heard.

U.S. Pat. No. 3,656,395 appears to be the most pertinent reference to the present invention. In that patent, the soundwaves emitted from the soundboard are directed by the shape of the back to the bridge area where an electrical pick-up is located.

In another invention, a violin innovator has increased the instrument volume by putting a sound post (a wooden peg) between the top and back, thereby directly transferring some of the vibrations from the bridge to the back.

SUMMARY OF THE INVENTION

The present invention has proven to produce a greater volume of musical sound accoustically than prior art without electrical amplification. This could prove to be a valuable quality with the emphasis on electrical conservation.

It is an object of the present invention to produce a greater volume of sound without electrical amplification.

It is another object of the present invention to produce a clear, crisp, more realistic sound from the vibrating strings.

The objectives have been accomplished by constructing the interior of the back to form a compound curve in the shape of a parabola. The back is made of a material that will efficiently reflect the sound waves from the soundboard. This hard, smooth material of the parabolically-curved back accurately reflects the sound waves which are streaming from the soundboard in a parallel fashion, directly through a strategically placed opening in the soundboard, hereafter called sound hole or holes, according to the design, thus utilizing both exterior and interior surfaces of the top. A good comparison showing the volume increase of this construction over the common box-type instruments would be the difference in volume between a grand piano with its lid open and the same one with its lid closed.

The back has the same principle in reverse as a reflector in a flashlight or headlight in that the waves emanate from a single source and are directed into a beam of parallel rays. The difference between the flashlight reflector and the back of the present invention is that the back reflects the parallel sound waves coming from the soundboard and focuses them at the center of the sound hole.

The waves emitted from the interior of the instrument only lag behind those coming from the top surface about one-one thousandth of a second, which is not discernable to the ear, and greatly adds to the volume of the waves emitted from the top of the soundboard. Thus, the air masses on both sides of the soundboard are undulated and the efficiency of the instrument is increased.

Since the soundwaves from the interior of the soundboard take only one bounce off of the parabola-shaped back and are out of the instrument through the sound hole in about one-one thousandth of a second, the tone quality is consequently clear, crisp and unobscured with more effectual overtones.

A system of braces is mounted to the underside of the soundboard. This brace system transmits the vibrations of the strings to a greater percentage area of the soundboard than in conventional string instruments, causing an overall responsiveness. The vibrations from the strings through a bridge on top of the soundboard, go directly to the braces, which carry them to the outermost parts of the soundboard. In addition, for further improvement of direct vibration transfer, fasteners are used to connect the bridge to the main braces mounted underneath the soundboard. These braces have side braces which affect virtually all the areas of the soundboard and all braces except the parallel braces on the side of the sound hole opposite the bridge emanate directly from the attachment of the bridge to the braces.

Other objects and features of the invention will become apparent to those skilled in the art as the disclosure is made in the following detailed description of a preferred embodiment of the invention, as illustrated in the accompanying drawings.

BRIEF DESCRIPTION OF THE DRAWINGS

FIG. 1 is a plan view of a stringed instrument.

FIG. 2 is a sectional view taken along line 2—2 of FIG. 1.

FIG. 3 is a sectional view taken along line 3—3 of FIG. 1.

FIG. 4 is a sectional view taken along line 4—4 of FIG. 2.

FIGS. 5–7 are typical side views of the various braces mounted to the underside of the soundboard shown in FIG. 4.

FIG. 8 is a sectional view taken along line 8—8 of FIG. 1.

FIG. 9 is an enlarged view of the vibrating transmission joint.

DESCRIPTION OF THE INVENTION

The novel features which are believed to be characteristic of the invention, both as to its organization and method of operation, together with further objects and advantages thereof, will be better understood from the following description considered in connection with the accompanying drawings in which an embodiment of the invention is illustrated by way of example. It is to be expressly understood, however, that the drawing is for the purpose of illustration and description only and is not intended as a definition of the limits of the invention. Furthermore, like character references are designated throughout the several drawings to denote similar parts.

Referring now to FIG. 1, there is illustrated a plan view of a standard guitar shape 10 which is chosen only because the general concept of the present invention is very adaptable thereto. The neck 20 with its fingerboard 21 and six strings 22 was chosen because of its popularity and general acceptance. But the present invention is susceptible to a variety of shapes and sizes, including the types of instruments that do not use frets 25 on the fingerboard 21 and those instruments that use a different number of strings 22. The opening 23 in the top or soundboard 26, or face of the instrument, commonly called the sound hole 23 is strategically placed and is at the focal point 27 of the parabolic curve 28 of the back 24 of the instrument 10 and shown in FIGS. 2 and 8.

FIG. 2 shows more clearly the relationship between the embodied components. The back 24 of the present invention is preferably made of glass cloth of appropriate thickness layed over a convex mold and impregnated with resin. Of course, one realizes there are many other ways to achieve this end, such as plastic molding, heating plexiglass or other plastic over a mold to form the desired shape, using a punch and die to form a metal part and others, but a fiberglass layup cuts cost and time. The principle of the present invention is the relationship of the top 26 to the back 24 to the sound hole 23.

Referring now to FIGS. 2 and 8 and utilizing the principle of the parabolic curve, it will be understood that soundwaves 29 emitted from the underside of the top 26 flow in a direction perpendicular from the top 26. Thereafter, the sound waves 29 strike the interior curve 28 of the back 24 and are reflected away from the back 24 at the same angle that they approach it. Angle of incidence equals angle of reflection. Reference is made to that of the reflection in a mirror or waves at the seashore. Therefore, at every point of a parabolic reflector it will reflect the waves to a single focal point. The present invention, using a hard sound wave reflecting surface 28, utilizes this principle and places the sound hole 23 at the focal point 27. Ideally, the focal point 27 is centered in the sound hole 23. So in principle, all soundwaves 29 that hit the parabolic curve 28 of the back 24 reflect directly through the sound hole 23 and can be heard, therefore improving on the prior art as far as volume of sound transmitted by adding the waves 29 of the bottom of the sound board 26 to those from the top of it, which are referenced as waves 39. So, no matter what size or peripheral shape the instrument shape is, as long as the above principles and relationships are in force, the instrument is in accord with the present invention.

FIGS. 3 and 8 present cross sectional views of the present invention showing that the back 24 has the compound curve of a parabola (which by description reflects parallel waves that are parallel to the symmetrical centerline 35 of the parabola to a single focal point). The sides 30 of the back 24 connect the parabolic portion of the back 24 with the top 26 of the instrument according to the periphery of the top 26. At the point of intersection of the back 24 and the top 26, the parts are connected either by adhesive such as epoxy, or by a mechanical means such as rivets, but the connection must be rigid.

FIG. 4 relates to the soundboard 26 which is the resonator and must be made of such a material that will resonate and transmit vibrations produced by the strings 22 and conducted through the bridge 31 to the soundboard 26 throughout its own length and breadth. The soundboard 26 should be generally planar. The limits of the present invention would encompass, then, various types of material including wood, metal and plastic for the top 26 of the instrument, or combinations thereof. The top 26 is firmly secured to the back 24 in order to produce the desired volume of sound.

On the interior side of the top 26 is a unique system of braces which aids in transmitting the vibrations over the majority of the area of the soundboard 26. These braces can be made of similar or dissimilar material to the top 26 and can vary in size, shape and number and still remain within the scope of the present invention, but the uniqueness of the braces in the present invention is that they all emanate from the attach point at each end of the bridge 31, spreading out like a fan and forming triangles. Thus, there are two main braces 32 and side braces 33. In addition, if applicable, there are parallel braces 34 on the far side of the sound hole 23 from the bridge 31 placed traversely between the main braces 32.

The long braces 32 receive the major portions of the vibrations and send them immediately and forcefully to all parts of the soundboard 26 by means of the side braces 33 and parallel braces 34 and thus a more even distribution of sound over the total surface of the soundboard 26 is achieved. Preferably, the braces 32 are tapered lengthwise from about one-half inch to one-quarter inch, and all exposed corners are rounded so as not to trap the vibrations in a sharp corner. The fan type side braces 33 are joined at the attach joint 40 of the bridge 31 to the longitudinal braces 32 for optimum results. They can be joined by adhesive or welding or any suitable process. The longitudinal braces 32 are solid from one end of the instrument to the other.

The braces 32, 33 and 34 receive the torque of the strings 22 pulling on the bridge 31 at the attach joint 40 and are somewhat pre-stressed. This is advantageous in that they are then a bit denser and will transmit the vibrations a little more quickly. This said torque is applied to the length of the longitudinal braces 32 at each end of the bridge 31, relieving the stress from the top 26 of the instruments and thus somewhat alleviating the common warpage problem of the top 26. This torque also allows the top 26 to be made more sensitive to vibrations by using a thinner material.

In addition to adhesive, a slight improvement was noticed by utilizing hold-down screws 42 with nuts and washers to attach the bridge 31 tightly to the top 26 and longitudinal braces 32 were drilled to receive the screws or bolts 42, to form a compressioned joint 40. The length of the bridge 31 covers the longitudinal braces 32 locations in order that they can receive the attachment screws 42 and have the fullest affect on the vibrational transmission.

The scope of the present invention is neither limited to the type of instrument such as the viol family, banjo, ukulele, dulcimer, mandolin, auto harp, to name a few, or types yet undefined or invented, nor is the present invention limited to a particular size of an existing instrument or later date innovations.

Now, therefore, I claim:

1. A stringed musical instrument having a body with a soundboard assembly for producing an optimum sound volume comprising in combination:

a. a soundboward having a planar interior underside surface and an exterior top surface and a sound hole passing therethrough;

b. a string bridge attached to said exterior surface of said soundboard;

c. a first and a second longitudinal main brace attached to said interior underside surface, each opposite of said sound hole and each disposed from said soundboard substantial upper to said soundboard substantial lower end, thereby each having a portion intersecting with said string bridge location being opposite at said exterior side of said soundboard;

d. a first and a second compressioned transmission joint having each a compression mechanical fastener, each said joint formed by (1) said bridge, (2) said soundboard inbetween said bridge and said portion of each said main braces intersecting with said bridge, (3) said portion of each said main braces intersecting with said bridge, (4) said compression mechanical fastener for connecting said bridge, soundboard and each said respective main braces in a predetermined constant compression;

(e) a plurality of side braces fastened to said soundboard interior underside surface and to each said first and to each said second compressioned transmission joint at each said portion of each said main braces intersecting with said bridge at said soundboard interior underside and emanating in fan-shaped fashion from each said joint;

(f) a plurality of parallel braces, parallel to one another at predetermined positions, each interconnecting said first and said second main braces at opposite sides of said sound hole; and (g) a backside having a parabolic interior shape rigidly connected at its periphery to said soundboard, whereby said parabolic interior shape is shaped and located in predetermined relationship to said sound hole location so that an imaginary focal point is obtained substantially at said sound hole center, said backside adapted to effect immediate transmission of associated sound wave vibrations from said soundboard interior underside surface towards said parabolic shape and for direct reflection therefrom through said sound hole focal point.

2. A stringed musical instrument having a body with a soundboard assembly for producing an optimum sound volume as claimed in claim 1, wherein said first and said second main braces, said side braces and said plurality of parallel braces are disposed and fastened on said interior underside surface of said soundboard in a substantially symmetrical arrangement covering said underside surface so that said associated sound wave vibrations are directly transmitted from said first and said second compressioned transmitting joint via all said braces for entire soundboard vibration and subsequent reflection toward said parabolic interior shape of said backside.

3. A stringed musical instrument having a body with a soundboard assembly for producing an optimum sound volume as claimed in claim 2, wherein said first and said second compressioned transmitting joint incorporates an adhesive material, said material integrally connecting said bridge to said soundboard exterior surface and said material connecting said soundboard interior surface to said portion of each said main braces, intersecting with said bridge, and said side braces emanating in fan-shaped fashion from said first and said second compressioned transmission joint.

4. A stringed musical instrument having a body with a soundboard assembly for producing an optimum sound volume as claimed in claim 3, wherein said compression mechanical fastener at said first and said second compressioned transmission joint comprises a bolt washer nut arrangement.

* * * * *